United States Patent [19]

Yoneyama et al.

[11] Patent Number: 5,003,958

[45] Date of Patent: Apr. 2, 1991

[54] IGNITION COIL MOUNTING STRUCTURE FOR ENGINE

[75] Inventors: Syuichi Yoneyama; Yoshinori Obana; Eiichi Fujisawa, all of Yokohama, Japan

[73] Assignee: Nissan Motor Co., Ltd., Yokohama, Japan

[21] Appl. No.: 456,642

[22] Filed: Dec. 27, 1989

[30] Foreign Application Priority Data

Dec. 27, 1988 [JP] Japan ..... 63-168943[U]
Feb. 23, 1989 [JP] Japan ..... 1-43434

[51] Int. Cl.[5] ..... F02P 3/02

[52] U.S. Cl. ..... 123/635; 123/90.38; 123/193 H; 123/634

[58] Field of Search ..... 123/635, 634, 647, 169 PA, 123/193 H, 90.38

[56] References Cited

U.S. PATENT DOCUMENTS 4,553,515 11/1985 King et al. ..... 123/193 H
4,831,995 5/1989 Biton ..... 123/635

FOREIGN PATENT DOCUMENTS 59-185877 10/1984 Japan ..... 123/635
59-226274 12/1984 Japan ..... 123/635
60-19948 2/1985 Japan ..... 123/635
62-74173 5/1987 Japan .

*Primary Examiner*—Andrew M. Dolinar
*Attorney, Agent, or Firm*—Foley & Lardner

[57] ABSTRACT

To facilitate mounting of each ignition coil into each coil mounting hole formed in each cylinder head accurately with respect to both the longitudinal and angular positions of each ignition coil, a cylinder head is formed with a coil mounting hole including a first large-diameter inclined coil mounting hole, a second small-diameter inclined coil mounting hole, and an intermediate partially conical surface for connecting the first and second inclined coil mounting holes in axially eccentric positional relationship with respect to each other; and an ignition coil formed with an outer casing so as to be inserted into the coil mounting hole formed in the cylinder head. Further, a rocker cover sealing member is disposed along each of junction circumferences of two coil mounting holes and between the cylinder head and the rocker cover to prevent lubricant from flowing from a cam chamber to the ignition coil casings and further to the ignition plugs.

11 Claims, 5 Drawing Sheets

BOTTOM VIEW

IGNITION COIL MOUNTING STRUCTURE FOR ENGINE

BACKGROUND OF THE INVENTION

1. Field of the Invention

The present invention relates to an ignition coil mounting structure for an internal combustion engine, in particular to an ignition coil mounting structure for mounting an ignition coil for each engine cylinder, independently.

2. Description of the Prior Art

A low power loss ignition apparatus is known such that a relatively small-sized ignition coil is provided for each cylinder head and a high tension (voltage) generated by each ignition coil is directly supplied to each ignition plug, as disclosed in Japanese Published Unexamined Utility Model application Ser. No. 62-74173, for instance.

FIG. 1 shows this prior art ignition apparatus, which comprises an ignition plug 1, an ignition coil casing 2 extending from the ignition plug 1 toward the upward direction, and an ignition coil 3 housed within the coil casing 2. When this prior-art ignition apparatus as shown in FIG. 1 is mounted on a DOHC (double overhead camshaft) engine, for instance, the coil casing 2 is mounted vertically passing through a hole formed in a rocker cover 4 and a middle straight hollow space 7 formed in a cylinder head 5. Further, the lowermost end of the coil casing 2 is screwed into a threaded ignition plug hole formed at the middle of the cylinder head 5 and the uppermost end of the coil casing 2 is fixed to the middle of the rocker cover 4 with a nut 6, so that the coil casing 2 is mounted vertically on the cylinder head 5.

In the above-mentioned prior-art ignition apparatus, however, since the ignition plug 1 and the ignition coil 3 11 are formed integral with each other within the casing and further the ignition plug 1 is fixed to the cylinder head 5 by inserting an end 2*a* of the casing 2 into an ignition hole via screw thread, the height and angular positions of the ignition plug 1 are determined after the ignition coil has been fixed to the cylinder head 5. In other words, there exists a problem in that the height and angular positions of the ignition plug 1 are not determined accurately, so that the orientation of an electric connector provided on top of the ignition coil 3 changes according to each cylinder; that is, the electric connectors are not arranged uniformly for all the cylinders, thus deteriorating the productivity of ignition plug mounting process into the cylinders. In addition, in the prior-art, since the ignition plug 1 and the ignition coil 3 are formed integral with each other, there exists another problem in that both the ignition plug 1 and the ignition coil 3 must be removed together from the cylinder head 5 and then disassembled in the case of maintenance, thus complicating the ignition plug mounting work.

Further, since the middle hollow space 7 through which the coil casing 2 is housed communicates with two cam journals 8 and two cam chambers 9 for accommodating cam bearings on the cylinder head 5, lubricant supplied to these cam journals 8 flows downward from the cam chambers 9 into the middle hollow space 7 as shown by two curved arrows. Therefore, there exists a problem in that the coil casing 2 is contaminated by the lubricant, in particular when the coil casing 2 is fixed to or removed from the cylinder head 5, so that the lubricant tends to reach the ignition plug 1 and therefore the ignition reliability is deteriorated. In addition, when the lubricant flows into the coil casing 2, there exist a harmful influence upon the various elements such as ignition coils, insulating members, etc.

SUMMARY OF THE INVENTION

With these problems in mind, therefore, it is the primary object of the present invention to provide an ignition coil mounting structure for an engine which can mount the ignition coil and the ignition coil independently to the cylinder head accurately with respect to both ignition plug height and angular positions.

Further, another object of the present invention is to provide an ignition coil mounting structure for an engine which can securely prevent lubricant supplied into the cam chamber from flowing into an ignition coil mounting hole, that is, an ignition coil casing.

To achieve the first above-mentioned object, the ignition coil mounting structure for an engine, according to the present invention, comprises: (a) cylinder head (11) formed with a coil mounting hole (18) including a first large-diameter inclined coil mounting hole (18*a*), a second small-diameter inclined coil mounting hole (18*b*), and an intermediate partially conical surface (23*d*) for connecting said first and second inclined coil mounting holes in axially eccentric positional relationship with respect to each other; and (b) an ignition coil (14) formed with an outer casing so as to be inserted into the coil mounting hole formed in said cylinder head.

To achieve the second above-mentioned object, the ignition coil mounting structure for an engine, according to the present invention, comprises: (a) a cylinder head (11) formed with a first coil mounting hole (18); (b) a rocker cover (12) formed with a second coil mounting hole (20) communicating with the first coil mounting hole when said rocker cover is fixed to said cylinder head so as to form a cam chamber between said cylinder head and said rocker cover; (c) an ignition coil (14) inserted into the first and second coil mounting holes; and (d) a rocker cover sealing member (50) disposed along at least one junction circumference portion of two coil mounting holes between said cylinder head and said rocker cover.

In the ignition coil mounting structure for an engine according to the present invention, since each ignition coil is formed by a large-diameter portion, a small-diameter portion, and an intermediate partially conical surface portion connected between the two in axially eccentric positional relationship with respect to each other, and inserted into two inclined coil mounting holes formed in the cylinder head and the rocker cover so as to be correspond to the ignition coil, it is possible to easily mount each ignition coil in the cylinder head tightly and accurately at both the predetermined longitudinal and angular positions, thus providing a uniform contact pressure with the ignition plug end terminal and a uniform electric connector orientation.

Further, since the axially eccentric ignition coils are mounted at roughly the middle of the rocker cover under inclination conditions, it is possible to prevent the vibration of the rocker cover and the ignition coils and also to mount the ignition coils at appropriate positions of V-type or DOHC engines.

Further, when the ignition coil mounting structure according to the present invention is applied to a V-type DOHC engine, in particular, it is preferable to mount ignition coils comprising (a) an outer coil casing (23A) formed with a large-diameter portion (23*b*), a small-diameter portion (23*c*) and an intermediate partially conical surface portion (23*d*) connected between said large-and small-diameter portions in axially eccentric positional relationship with respect to each other so formed as to be fitted to said inclined first and second coil mounting holes (18, 20) formed in said cylinder head and rocker cover, respectively; (b) an inner insulated coil casing (23B) fitted to said outer coil casing; (c) an iron core (30) disposed within the inner coil casing; (d) primary and secondary coils (24) wound around said iron core and housed within said inner coil casing (23B); (e) a coil spring (32) attached to a lowermost end of said inner insulated coil casing and connected to said secondary coil; and (f) a coil terminal member (33) urged by said coil spring into elastic contact with a terminal end (29*a*) of an ignition plug (29).

Each ignition coil is supported by an upper cylindrical coil casing supporting elastic member (27) disposed between said insulated inner coil casing (23B) and said rocker cover at an uppermost end of said inner coil casing, and a lower cylindrical coil casing supporting elastic member (25) attached to a lower end of the small-diameter portion (23*c*) of said outer coil casing (23A) within the second small-diameter coil mounting hole (18*b*) in said cylinder head.

In the ignition coil mounting structure for an engine according to the present invention, said each rocker cover sealing member is disposed along each of junction circumferences of two coil mounting holes and between the cylinder head and the rocker cover, it is possible to securely prevent lubricant within the cam chamber from flowing into each ignition coil mounting hole in cooperation with the lower coil casing supporting elastic member (25), that is, to the ignition coil casing for protection of ignition elements from lubricant.

DETAILED DESCRIPTION OF THE PREFERRED EMBODIMENTS

An embodiment of the present invention will be described hereinbelow with reference to the attached drawings, in which the ignition coil mounting structure according to the present invention is applied to a V-type six-cylinder DOHC engine, by way of example.

Figure 1:
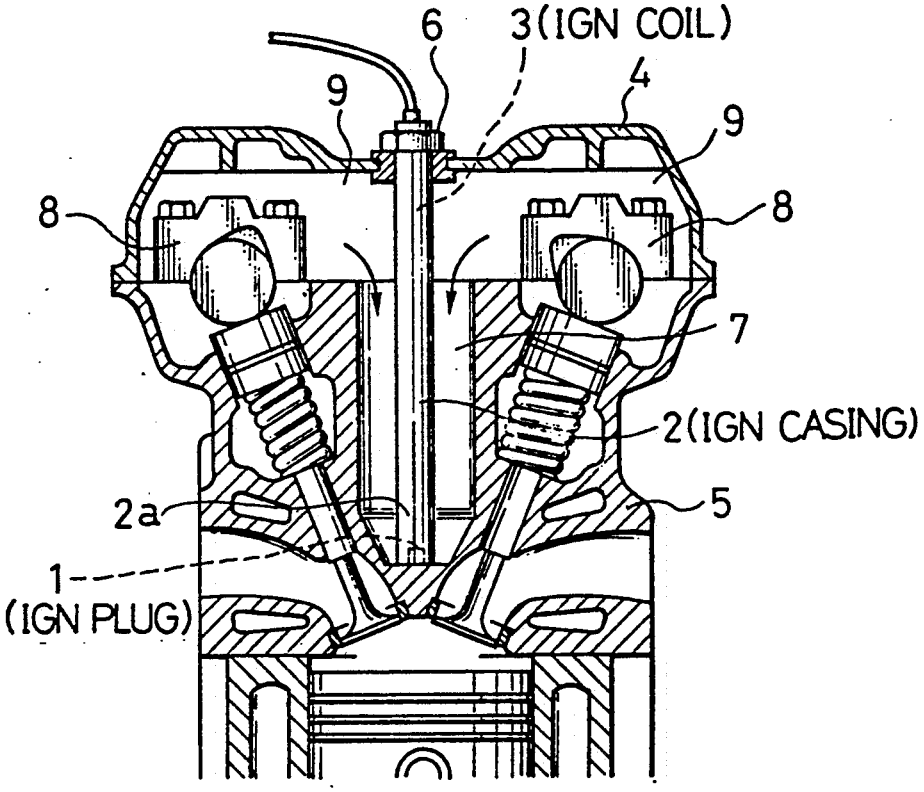
FIG. 1 PRIOR ART
FIG. 1 is a cross-sectional view showing a prior-art ignition coil mounting structure.
Figure 2:
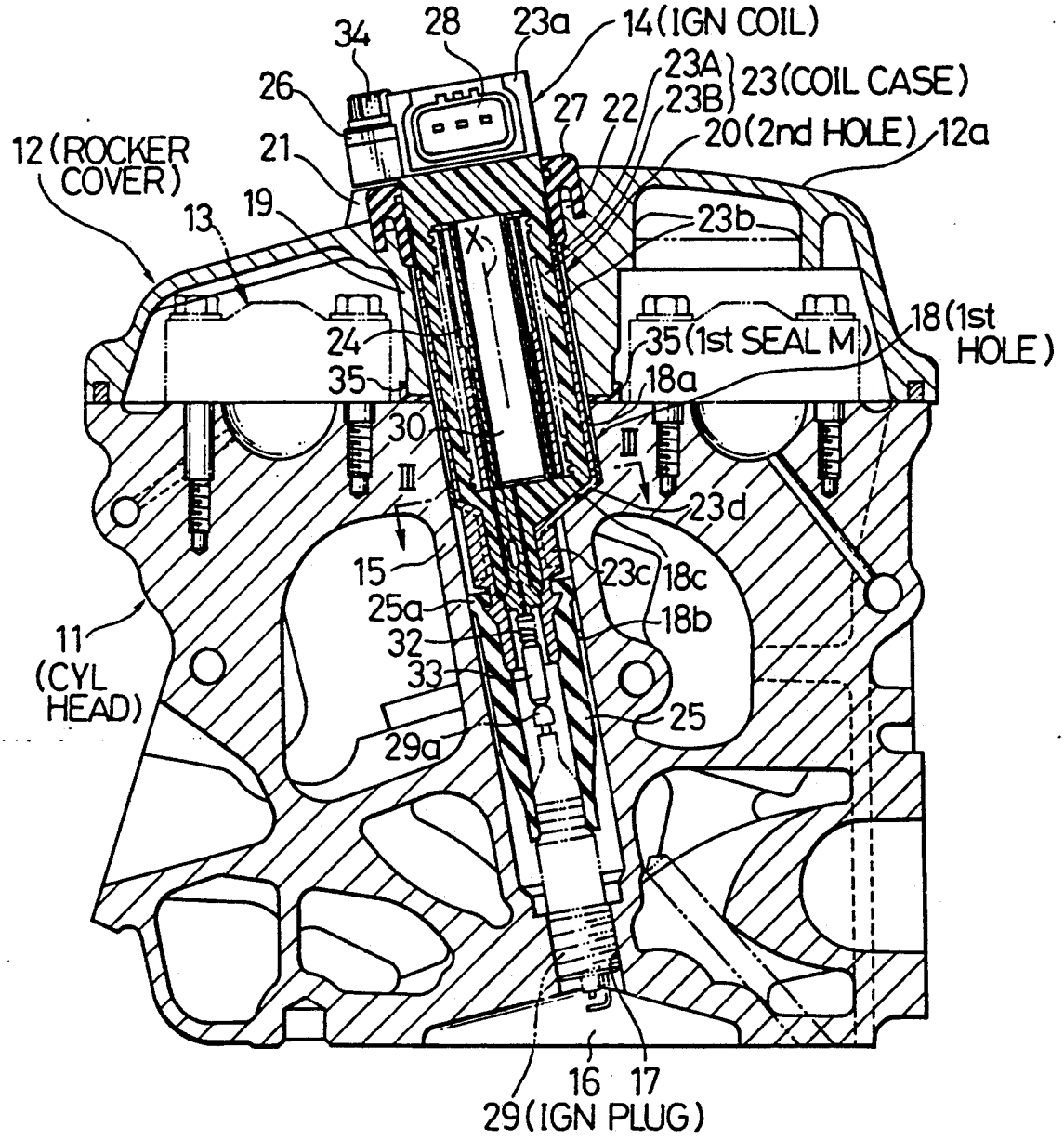
FIG. 2 is a cross-sectional view showing an embodiment of the ignition coil mounting structure according to the present invention, which is applied to a DOHC engine, by way of example.

In FIG. 2 where only a single ignition coil 14 is shown, an ignition coil 14 is obliquely mounted passing through a rocker cover 12 and a cylinder head 11. The rocker cover 12 is fixed with bolts (not shown) to the upper end surface of the cylinder head 11 so as to form a cam chamber 13 between the two. The ignition coil 14 is mounted passing both the rocker cover 12 and the cylinder head 11.

Figure 3:
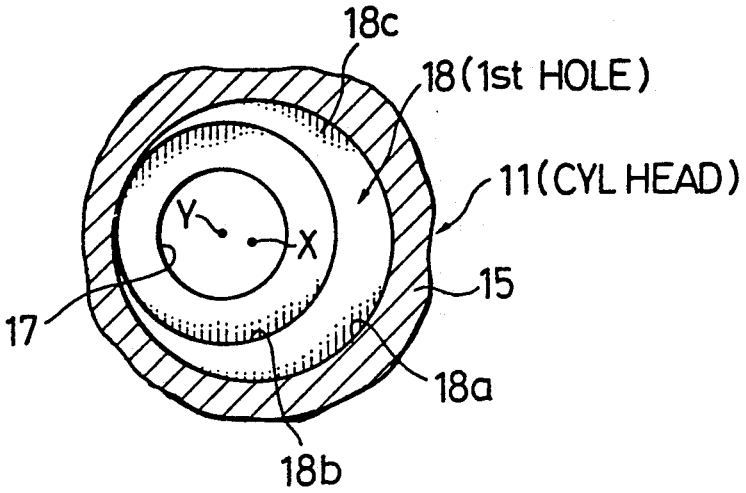
FIG. 3 is an enlarged cross-sectional view showing an ignition coil mounting hole according to the present invention, taken along the line III—III in FIG. 2.

Within the cylinder head (e.g. made of aluminum alloy), intake and exhaust valves (not shown) are arranged oppositely at a predetermined included angle. An inclined ignition plug mounting hole 17 is formed at the lowermost position of a middle portion 15 of the cylinder head 11 and between the intake and exhaust valves so as to communicate with a combustion chamber 16. Further, a first inclined coil mounting hole 18 is formed passing through the cylinder head 11 over the ignition plug mounting hole 17. As shown in FIGS. 2 and 3, the first inclined coil mounting hole 18 is formed into a first large diameter portion 18*a* on the upper side of the cylinder head 11 and a second small diameter portion 18*b* on the lower side thereof extending toward the ignition plug mounting hole 17, in such a way that a center X of the first large-diameter portion 18*a* is a little dislocated from a center Y of the second small-diameter portion 18*b* in the rightward direction in FIG. 3. An intermediate partially conical surface portion 18*c* is formed between the two larger- and small-diameter portions 18*a* and 18*b* into a downward extending tapered shape, when seen in cross section in FIG. 2.

Figure 5:
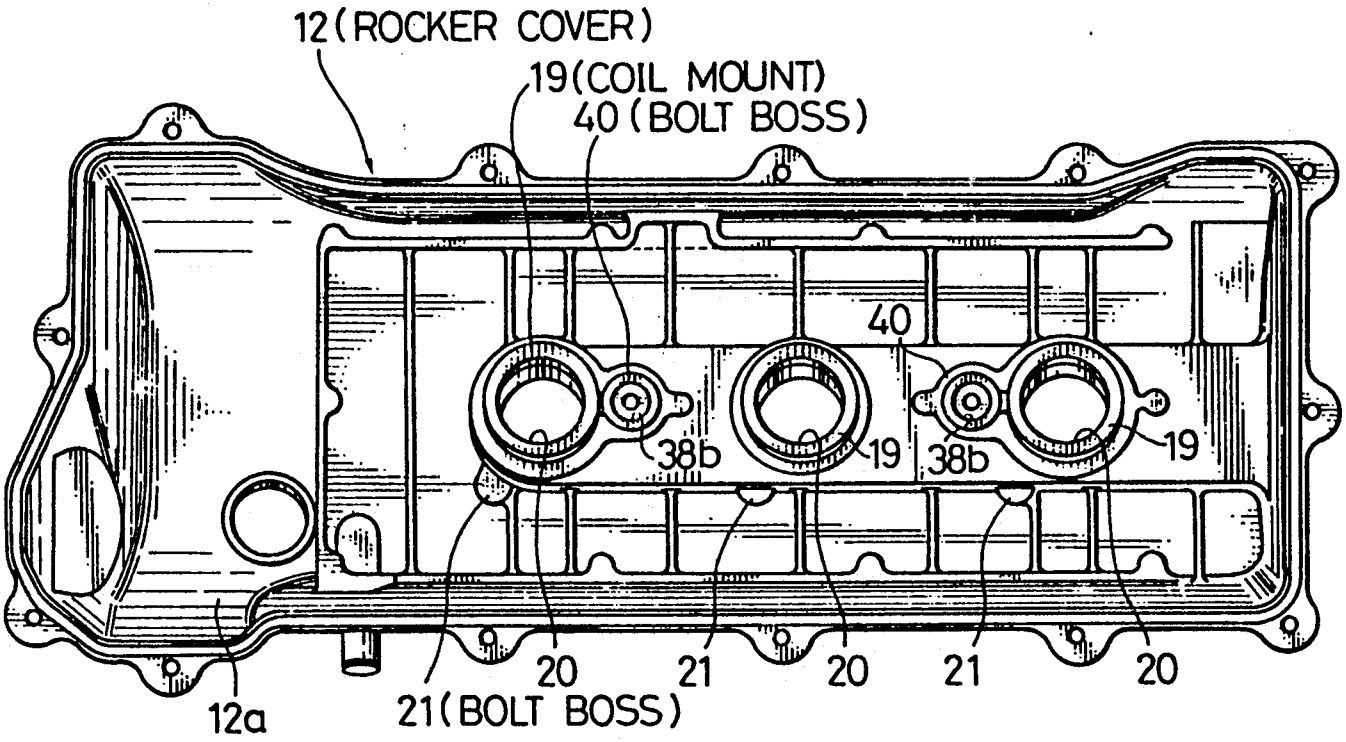
FIG. 5 is a bottom view showing a rocker cover fixed to a cylinder head of the engine to which the mounting structure of the present invention is applied.

As shown in FIGS. 2 and 5, the rocker cover 12 is formed with a roughly circular arc shaped upper wall 12*a*, and three first inclined cylindrical coil mounting portions 19 are formed being arranged straight along roughly the middle line of the upper wall 12*a* thereof so as to correspond in position to the three middle portions 15 of the cylinder head 11. Each inner hole of each first inclined cylindrical mounting portion 19 corresponds to a second coil mounting hole 20 communicating with the first large-diameter inclined coil mounting hole 18*a* of the first coil mounting hole 18 formed in the cylinder head 11, when the rocker cover 12 is fixed to the cylinder head 11.

In FIG. 5, two second small-diameter vertical cylindrical bolt boss portions 40 are formed between the two adjacent first cylindrical coil mounting portions 19 being arranged along the same middle line of the upper wall 12*a* of the rocker cover 12. A bolt is inserted into each inner hole 38*b* of the bolt boss portion 40 to fix the rocker cover 12 to the cylinder head 11.

Further, three other bolt boss portions 21 are formed near the first cylindrical coil mounting portions 19. Each bolt boss portion 21 is formed with a thread hole (not shown) on the outside surface thereof to which a bolt 34 for fixing the ignition coil 14 to the rocker cover 12 is screwed, as shown in FIG. 2.

Further, as shown in FIG. 2, three outwardly extending annular locating projections 22 (not seen in FIG. 5 and shown in FIG. 2) are formed along the second coil mounting holes 20, respectively.

Figure 4:
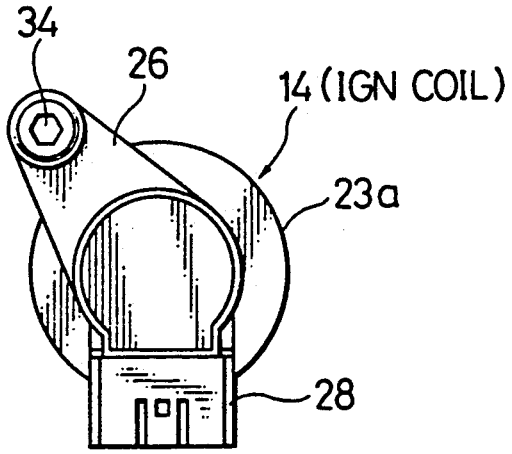
FIG. 4 is a top plan view showing an ignition coil of the present invention.

As shown in FIGS. 2 and 4, the ignition coil 14 is composed of a coil casing 23 including an outer metallic coil casing 23A and an inner plastic coil casing 23B fitted to the outer metallic coil casing 23A; an iron core 30 disposed within the inner plastic coil casing 23B; primary and secondary coils 24 wound around the iron core 30 and housed within the inner plastic coil casing 23B; a coil spring 32 attached to the lowermost end of the outer insulated coil casing 23A and connected to one end of the secondary coil, and a coil terminal member 33 urged by the coil spring 32 into elastic contact with a terminal end 29*a* of an ignition plug 29.

An upper cylindrical member 23*a* is attached on top of the inner plastic coil casing 23A, as shown in FIG. 4, to which a lug portion 26 extending radially sideward from the cylindrical member 23*a* is formed to fix the coil casing 14 to the rocker cover 12. Further, an electric connector box 28 is attached to the upper cylindrical member 23*a* oriented radially sideward from the member 23*a*.

The outer metallic coil casing 23A is formed with a large-diameter portion 23*b*, a small diameter portion 23*c*, and an intermediate partially conical surface portion 23*d* so as to be fittable to the coil mounting holes such as the second hole 20 and the first hole 18 composed of the large diameter inclined coil mounting hole 18*a* and the small-diameter inclined coil mounting hole 18*b* formed in the cylinder head 11.

The ignition coil 14 is supported by a lower cylindrical coil casing supporting elastic member 25 and an upper cylindrical coil casing supporting elastic member 27. The elastic member 25 is formed with a flange 25*a* engaged with a recess formed at the lower portion of the small-diameter portion 23*c* of the outer metallic coil casing 23A and further brought into elastic contact with the inner circumferential surface of the small-diameter coil hole 18*b* formed in the cylinder head 11 so as to cover the coil terminal member 33 and the coil spring 32. Further, these coil casing elastic members 25 and 27 are made of a heat-resistant synthetic rubber.

The lug portion 26 is fixed to the boss portion 21 of the rocker cover 12 with a bolt 34 by interposing a cylindrical coil casing supporting elastic member 27 between the inner plastic coil casing 23B and the rocker cover 12. In this case, the annular locating projection 22 of the rocker cover 12 is engaged with the annular recess formed in the coil casing supporting elastic member 27. Further, the electric connector box 28 is attached to the upper cylindrical member 23*a* of the inner plastic coil casing 23B so as to be oriented toward the camshafts so that a mated power supply connector can be engaged with the connector box 28 from the camshaft side.

The coil casing 23 composed of the outer and inner coil casing 23A and 23B is so formed as to be inserted into the coil mounting holes formed in the cylinder head 11 and the rocker cover 12. In more detail, the outer coil casing 23A is formed with a large cylindrical portion 23*b* inserted into the second coil mounting hole 20 in the rocker cover 12 and the large diameter portion 18*a* of the first coil mounting hole 18 in the cylinder head 11, and a small cylindrical portion 23*c* inserted into the small diameter portion 18*b* of the first coil mounting hole 18, in such a way that the center X of the large cylindrical portion 23*b* is dislocated from that Y of the small cylindrical portion 23*c* the same axially eccentric distance away as that between the large diameter coil mounting hole 18*a* and the small diameter coil mounting hole 18*b* of the cylinder head 11. Further, an intermediate partially conical surface portion 23*d* connected between the two large and small cylindrical portions 23*b* and 23*c* is formed into a downward extending tapered shape in axially eccentric positional relationship with respect to each other so as to be fittable to the intermediate partially conical surface 18*c* for connecting the large and small inclined coil mounting holes 18*a* and 18*b* formed in the cylinder head 11.

Figure 6:
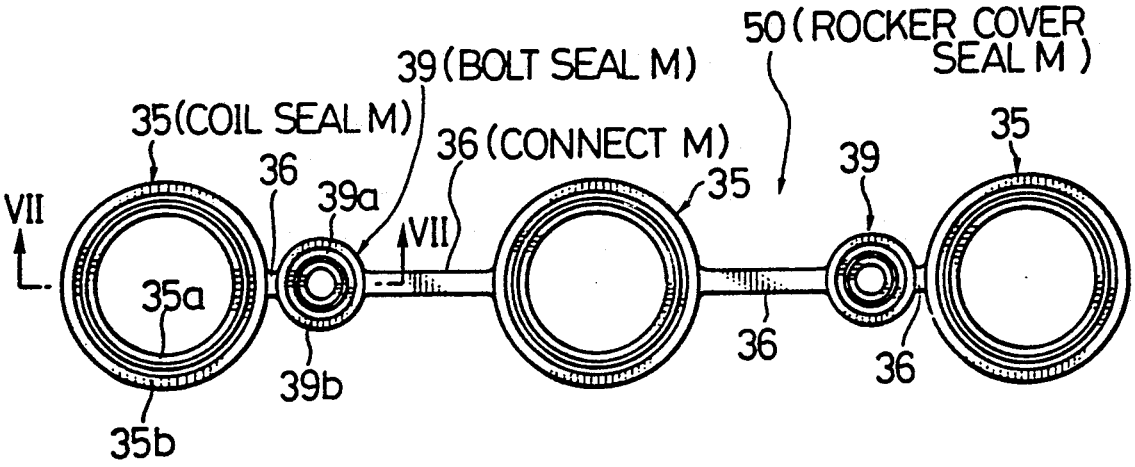
FIG. 6 is a plan view showing a rocker cover sealing member used for the mounting structure according to the present invention.
Figure 7:
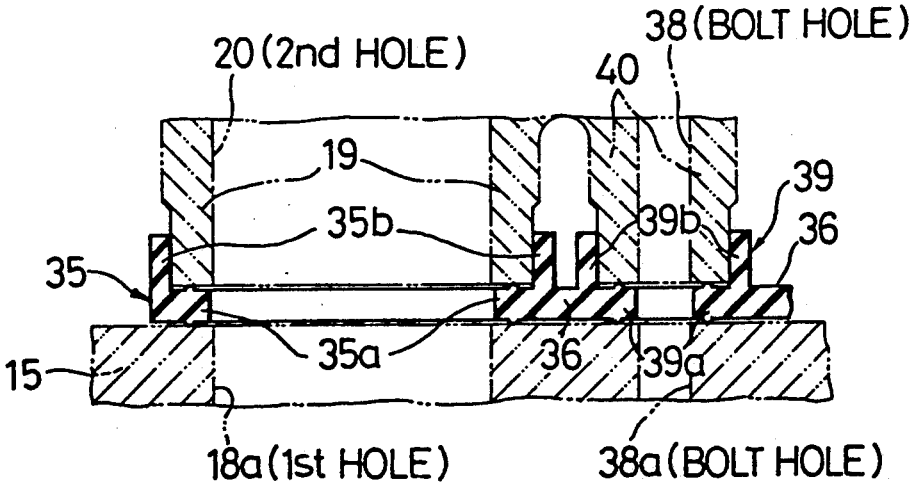
FIG. 7 is a cross-sectional view taken along the line VII—VII in FIG. 6.

With reference to FIGS. 2, 5, 6 and 7, a rocker cover sealing member 50 of the feature according to the present invention will be described hereinbelow. In FIG. 2, a first annular seal member 35 for sealing the junction point between the cylinder head 11 and the rocker cover 12 is interposed between the upper surface of the middle portion 15 of the cylinder head 11 and the lower surface of the cylindrical coil mounting portion 19 of the rocker cover 12, that is, at an annular junction circumference between the first coil mounting hole 18 of the cylinder head 11 and the second coil mounting hole 20 of the rocker cover 12, as shown in FIG. 2. As shown in FIGS. 6 and 7, the rocker cover sealing member 50 is composed of three large-diameter coil seal members 35, two small-diameter bolt seal members 39 and connection members 36. The first large-diameter annular coil seal member 35 is formed with a horizontally annular base portion 35*a* and a vertically cylindrical side wall portion 35*b* into an L-shaped cross section. The inner diameter of the annular base portion 35*a* is determined substantially the same as that of the large diameter portion 18*a* of the first coil mounting hole 18 (of the cylinder head 11) or the second coil mounting hole 20 (of the rocker cover 12), and the inner diameter of the cylindrical side wall portion 35*b* is determined substantially the same as the outer diameter of the first cylindrical coil mounting portion 19 of the rocker cover 12. Further, a second small-diameter annular bolt seal member 39 for sealing the bolt junction point between the cylinder head 11 and the rocker cover 12 is formed, in the vicinity of the first large-diameter annular coil seal member 35, with a horizontally annular base portion 39*a* and a vertically cylindrical side wall portions 39*b* also into an L-shaped cross section. The inner diameter of the annular base portion 39*a* is determined substantially the same as that of a bolt hole 38*a* formed in the cylinder head 11 and another bolt hole 38*b* formed in the rocker cover 12, and the inner diameter of the cylindrical side wall portion 39*b* is determined substantially the same as the outer diameter of the second cylindrical bolt boss portion 40 of the rocker cover 12. This second bolt seal member 39 serves to seal the edges of the two bolt holes 38*a* and 38*b* through which a bolt (not shown) is passed to fix the rocker cover 12 to the cylinder head 11. In summary, the first large-diameter annular coil seal member 35 is fitted to the first cylindrical coil mounting portion 19 of the rocker cover 12 and the second small diameter annular bolt seal member 39 is fitted to the second cylindrical bolt boss portion 40 of the rocker cover 12.

Further, in FIG. 5, since three cylinders are arranged in a straight line on a single bank so as to correspond to three ignition coil mounting holes 18*a* or 20, the three first large-diameter annular coil seal members 35 and two second small-diameter annular bolt seal members 39 are connected straight in series into a single seal member via a straight narrow connection member 36 as shown in FIG. 6. The rocker cover seal member 50 is made of a heat-resistant synthetic rubber.

The function of the ignition coil mounting structure will be described hereinbelow. In order to dispose the rocker cover seal member 50, the first coil seal members 35 are fitted to the ends of the first large-diameter cylindrical coil mounting portions 19 of the rocker cover 12 and the second bolt seal members 39 are fitted to the second small-diameter cylindrical bolt boss portions 40 thereof. Thereafter the rocker cover 12 to which the rocker cover seal member 50 is attached is placed on the cylinder head 11 at an appropriate location and then fixed to the cylinder head 11 with bolts passed through the second cylindrical bolt boss portions 40. In this case, the annular base portions 35*a* of the first coil seal members 35 are sandwiched between the upper surface of the middle portion 15 of the cylinder head 11 and the lower surfaces of the first cylindrical coil mounting portions 19 of the rocker cover 12, so that the junction circumferential surfaces between the cylinder head 11 and the rocker cover 12 at each ignition coil mounting hole 18*a* or 20 can be watertightly sealed. In addition, the annular base portions 39*a* of the second bolt seal members 39 are also sandwiched between the upper surface of the middle portion 15 of the cylinder head 11 and the lower surfaces of the second cylindrical boss portions 40 of the rocker cover 12, so that the junction circumferential surfaces between the two 11 and 12 at each bolt hole 38*a* can be also watertightly sealed. Here, since the plural first and second seal members 35 and 39 are all connected straight in series via the connection member 36, it is possible to facilitate mounting of the rocker cover seal member 50 on the rocker cover 12 and managing of parts stock.

Thereafter, the ignition plug 29 is screwed into each ignition plug hole 17, and then the ignition coil 14 is mounted on the cylinder head 11. That is, the ignition coil 14 is inserted into the second hole 20 in the rocker cover 12 and the first hole 18 of the cylinder head 11, so that the outer coil casing 23A of the ignition coil 14 can be guided along the inner surfaces of the large and small diameter coil mounting holes 18*a* and 18*b*. In this case when the eccentric conical slopping surface 23*d* of the outer coil casing 23A is brought into contact with the intermediate eccentric conical slopping surface 18*c* of the first coil mounting hole 18, the ignition coil 14 is rotated a little so that both the sloping surfaces 23*d* and 18*c* can be brought into tight contact with each other. Under these conditions, the ignition coil 14 can be correctly fitted to the first coil mounting hole 18 of the cylinder head 11 at both accurate longitudinal and angular positions. When the ignition coil 14 has been correctly inserted into the coil mounting holes 18 and 20, the flange 25*a* of the lower cylindrical coil casing supporting elastic member 25 is in elastic contact with the inner circumferential surface of the small-diameter hole 18*b* of the engine cylinder 11, and further the upper cylindrical coil casing supporting elastic member 27 attached to the upper end of the inner coil casing 23B is engaged with the annular locating projection 22 of the rocker cover 12, so that the mounting lug portion 26 extending from top of the ignition coil 14 can be fixed to the boss portion 21 of the rocker cover 12 with bolts 34.

The above-mentioned ignition coil mounting structure has various advantages as follows:

(a) The ignition coil 14 can be fixed to the cylinder head 11 and the rocker cover 12 uniformly tightly and accurately at both the predetermined longitudinal and angular positions due to the presence of the eccentric coil casing 14. That is, since the longitudinal height position of the ignition coils 14 can be correctly determined, it is possible to make uniform the contact pressure between the terminal member 33 of the ignition coil 14 and the terminal end 29*a* of the ignition plug 29. Further, since the angular position of the ignition coil 14 can be correctly determined, it is possible to uniformly and correctly arrange the orientation of the electric connector box 28 attached on top of the ignition coil 14 toward the camshaft. In addition, the contact engagement between the sloping surface 23*d* of the outer coil casing 23A and the intermediate sloping surface 18*c* of the first coil mounting hole 18 formed in the cylinder head 11 facilitates the assembly work at the manufacturing process because the ignition coil 14 can be easily and accurately mounted to the cylinder head 11 at both the longitudinal and angular positions, thus improving the productivity.

(b) Since the lug portion 26 of each ignition coil 14 is fixed to each boss portion 21 of the rocker cover 12 with a bolt 34 separately, it is possible to correctly mount each ignition coil 14 to the cylinder head 11 and the rocker cover 12 independently under well balanced conditions. Therefore, it is possible to prevent the ignition coil 14 from being vibrated within the cylinder head 11 during engine running.

(c) Since the ignition coils 14 are arranged along roughly the middle of the rocker cover 12, and therefore the rocker cover 12 is fixed to the cylinder head 11 along the middle line of the rocker cover, it is possible to effectively prevent the rocker cover 12 from being vibrated by the cylinder head. The above-mentioned vibration prevention effect maintains an excellent sealing effect between the cylinder head 11 and the rocker cover 12.

(d) Since the upper cylindrical coil casing supporting elastic member 27 is engaged with the annular locating projection 22 and additionally the flange 25*a* of the lower cylindrical coil casing supporting elastic member 25 is in elastic contact with the inner surface of the small-diameter portion 18*b* of the first hole 18, it is possible to protect the ignition coil 14 (the terminal member 33, in particular) from vibration of the rocker cover 12 and the cylinder head 11 by means of these elastic members 27 and 25. Further, since the first coil mounting hole 18 (the small-diameter hole 18*b*, in particular) can be sealed doubly by the first coil seal member 35 of the rocker cover sealing member 50 and the flange 25*a* of the coil supporting elastic member 25 from the cam chamber 13, it is possible to more reliably prevent lubricant from flowing down to the ignition plug 29.

(e) Since the ignition coil 14 is disposed in eccentric positional relationship with respect to the ignition plug 29, it is possible to advantageously arrange the ignition coils 14 for not only the DOHC engines but also V-type engines. This is because in the case of the DOHC engines, when the concentric ignition coils are mounted at the middle between a pair of camshafts, the included angle between the intake and exhaust valves is restricted, so that it is difficult to mount the concentric ignition coils on the DOHC engines. Further, in the case of the V-type engines, when the concentric ignition coils are mounted at the middle between the two cylinder heads, since the ignition coils must be located at the lower position due to the angle between the two banks, it is difficult to check or repair the ignition coils for maintenance.

As described above, in the ignition coil mounting structure according to the present invention, the eccentric ignition coils can be applied to various engines. Since the coil mounting hole is formed so as to be composed of a large-diameter inclined coil mounting hole, a second small-diameter inclined coil mounting hole, and an intermediate partially conical surface in axially eccentric positional relationship with respect to each other, it is possible to accurately and easily mount the ignition coils to the cylinder heads. Further, since the ignition coil mounting holes can be watertightly sealed from the cam chamber by means of the single rocker cover sealing member, it is possible to securely prevent lubricant from flowing into the ignition coil mounting hole, that is, to the ignition plug, thus improving ignition reliability.

What is claimed is:

1. An ignition coil mounting structure for an engine, comprising:

(a) a cylinder head formed with a coil mounting hole including a first large-diameter inclined coil mounting hole, a second small-diameter inclined coil mounting hole, and an intermediate partially conical surface for connecting said first and second inclined coil mounting holes in axially eccentric positional relationship with respect to each other; and (b) an ignition coil formed with an outer casing so as to be inserted into the coil mounting hole formed in said cylinder head.

2. An ignition coil mounting structure for an engine, comprising:

(a) a cylinder head formed with a first coil mounting hole including a first large-diameter inclined coil mounting hole, a second small-diameter inclined coil mounting hole, and an intermediate partially conical surface for connecting said first and second inclined coil mounting holes in axially eccentric positional relationship with respect to each other;

(b) a rocker cover formed with a second coil mounting hole communicating with the first coil mounting hole when said rocker cover is fixed to said cylinder head so as to form a cam chamber between said cylinder head and said rocker cover; said second coil mounting hole formed in said rocker cover being also inclined so as to be connected straight with the first large-diameter inclined coil mounting hole of said cylinder head; and (c) an ignition coil formed so as to be inserted into the first and second coil mounting holes of said cylinder head and said rocker cover.

3. The ignition coil mounting structure of claim 2, wherein said ignition coil comprises:

(a) an outer coil casing formed with a large-diameter portion, a small-diameter portion and an intermediate partially conical surface portion connected between said large- and small-diameter portions in axially eccentric positional relationship with respect to each other so formed as to be fitted to said inclined first and second coil mounting holes formed in said cylinder head and rocker cover, respectively;

(b) an inner insulated coil casing fitted to said outer coil casing;

(c) an iron core disposed within the inner coil casing;

(d) primary and secondary coils wound around said iron core and housed within said inner coil casing;

(e) a coil spring attached to a lowermost end of said inner insulated coil casing and connected to said secondary coil; and (f) a coil terminal member urged by said coil spring into elastic contact with a terminal end of an ignition plug.

4. The ignition coil mounting structure of claim 3, wherein said ignition coil further comprises an upper cylindrical member fixed on top of said inner insulated coil casing and formed with a fixing lug portion extending radially from said upper cylindrical member for fixing said ignition coil to said rocker cover and with an electric connector box for supplying electric power to said primary coil.

5. The ignition coil mounting structure of claim 3, wherein said ignition coil further comprises an upper cylindrical coil casing supporting elastic member disposed between said insulated inner coil casing and said rocker cover at an uppermost end of said inner coil casing, and a lower cylindrical coil casing supporting elastic member attached to a lower end of the small-diameter portion of said outer coil casing within the second small-diameter coil mounting hole formed in said cylinder head.

6. The ignition coil mounting structure of claim 2, which further comprises a rocker cover sealing member disposed along at least one junction circumference portion of the two coil mounting holes between said cylinder head and said rocker cover.

7. The ignition coil mounting structure of claim 6, wherein said rocker cover sealing member comprises a first seal member formed into an L-shaped cross section having an annular base portion sandwiched between an upper end surface of said cylinder head and a lower end surface of said rocker cover and a cylindrical side wall portion fitted to an outer circumferential surface of a first cylindrical coil mounting portion of said rocker cover through which the second coil mounting hole is formed.

8. The ignition coil mounting structure of claim 7, wherein said rocker cover sealing member further comprises a second seal member formed into also an L-shaped cross section having an annular base portion sandwiched between the upper end surface of said cylinder head and the lower end surface of said rocker cover and a cylindrical side wall portion fitted to an outer circumferential surface of a second cylindrical bolt boss portion of said rocker cover through which a bolt insertion hole is formed.

9. The ignition coil mounting structure of claim 8, wherein said first seal member and said second seal member are connected to each other by at least one connection member.

10. The ignition coil mounting structure of claim 9, wherein when a plurality of ignition coils are inserted into the first and second coil mounting holes formed in said cylinder head and said rocker cover, separately, said rocker cover sealing member comprises a plurality of the first seal members corresponding to the number of said ignition coils and a plurality of the second seal members arranged between two adjacent first seal members, all said first and second seal members being connected straight in series by a plurality of said connection members.

11. The ignition coil mounting structure of claim 6, wherein said rocker cover sealing member is made of a heat-resistant synthetic rubber.

* * * * *